US010573980B2

(12) United States Patent
Mathews

(10) Patent No.: US 10,573,980 B2
(45) Date of Patent: Feb. 25, 2020

(54) COAXIAL DROP CABLE WITH CIRCUMFERENTIAL SEGMENTED FLOODANT LOCATIONS

(71) Applicant: PPC Broadband, Inc., East Syracuse, NY (US)

(72) Inventor: Roger Mathews, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/051,459

(22) Filed: Jul. 31, 2018

(65) Prior Publication Data

US 2019/0036239 A1 Jan. 31, 2019

Related U.S. Application Data

(60) Provisional application No. 62/539,111, filed on Jul. 31, 2017.

(51) Int. Cl.

| | |
|---|---|
| ***H01B 7/00*** | (2006.01) |
| ***H01R 9/03*** | (2006.01) |
| ***H01B 11/18*** | (2006.01) |
| ***H01R 9/05*** | (2006.01) |

(52) U.S. Cl.

CPC ..... *H01R 9/034* (2013.01); *H01B 11/1869* (2013.01); *H01B 11/1895* (2013.01); *H01R 9/0518* (2013.01)

(58) Field of Classification Search

CPC ..... H01B 11/1869; H01B 11/1865; H01R 9/0518; H01R 9/034

USPC ..... 174/28, 102 R, 103, 105 R, 106 R, 108, 174/74 R, 78, 84 R, 88 C

See application file for complete search history.

(56) References Cited

U.S. PATENT DOCUMENTS

| | | | | |
|---|---|---|---|---|
| 3,634,606 | A | 1/1972 | Iyengar | |
| 3,697,670 | A * | 10/1972 | Mitacek | H01B 7/2825 174/107 |
| 4,495,225 | A * | 1/1985 | Ciuba | C09D 5/08 106/14.23 |
| 4,980,001 | A | 12/1990 | Cornibert et al. | |
| 5,142,105 | A * | 8/1992 | Kihlken | H01B 13/34 174/112 |

(Continued)

OTHER PUBLICATIONS

Oct. 22, 2018 International Search Report and Written Opinion issued in International Application No. PCT/US18/44717.

*Primary Examiner* — William H. Mayo, III
(74) *Attorney, Agent, or Firm* — Oliff PLC

(57) ABSTRACT

A cable includes a core having a length, a jacket coaxially surrounding the core along the length, and a non-flowing floodant between the core and the jacket. The non-flowing floodant is disposed circumferentially and in a segmented manner such that the coaxial drop cable is configured to include a plurality of first areas, separated from one another along the length, that include the non-flowing floodant, and second areas, separated from one another along the length by a respective one of the first areas, having a space between the jacket and the core without the non-flowing floodant. The non-flowing floodant is configured to circumferentially seal a space between the core and the jacket at the plurality of first areas. Two consecutive ones of the plurality of first areas are configured to contain moisture in the second area between the two consecutive ones of the plurality of first areas.

20 Claims, 9 Drawing Sheets

(56) References Cited

U.S. PATENT DOCUMENTS 5,371,823 A 12/1994 Barrett et al.
5,397,843 A * 3/1995 Lakshmanan ..... C08L 23/0815 525/240
5,468,807 A * 11/1995 Tsurutani ..... C08L 23/10 525/240
5,539,056 A * 7/1996 Yang ..... C08L 23/10 525/240
5,719,353 A 2/1998 Carlson et al.
5,777,535 A 7/1998 Farfoud et al.
5,796,042 A 8/1998 Pope
6,265,667 B1 * 7/2001 Stipes ..... H01B 7/28 174/102 R
6,596,393 B1 * 7/2003 Houston ..... C23F 11/149 174/109
6,610,932 B2 * 8/2003 Van Den Berg ..... H01B 13/30 174/120 R
6,693,241 B2 2/2004 Carlson et al.
7,084,343 B1 * 8/2006 Visser ..... C09D 167/00 174/102 R
7,211,733 B2 * 5/2007 Kurimoto ..... H01B 7/365 174/110 R
7,244,337 B2 * 7/2007 Bahlmann ..... B32B 5/26 156/580.2
7,482,539 B2 * 1/2009 Katsumata ..... H01B 7/361 174/110 R
7,629,536 B2 12/2009 Stutzman et al.
8,148,639 B2 * 4/2012 Auphand ..... H01B 7/36 174/110 R
8,513,526 B2 * 8/2013 Sugimura ..... H01B 7/361 174/112
2004/0213532 A1 * 10/2004 Wyatt, II ..... H01B 11/1878 385/123
2005/0056453 A1 * 3/2005 Gialenios ..... H01B 11/1834 174/105 R
2009/0114418 A1 * 5/2009 Smith ..... G09F 3/00 174/112
2011/0061887 A1 * 3/2011 Amato ..... H01B 7/2806 174/102 R
2011/0132633 A1 * 6/2011 Montena ..... H01B 11/1869 174/28
2013/0331479 A1 * 12/2013 Dupont ..... C08F 287/00 522/183
2014/0121325 A1 * 5/2014 Holtcamp ..... C08L 23/14 525/195
2015/0267087 A1 * 9/2015 Botros ..... C08L 23/10 524/151

* cited by examiner

COAXIAL DROP CABLE WITH CIRCUMFERENTIAL SEGMENTED FLOODANT LOCATIONS

CROSS-REFERENCE TO RELATED APPLICATION

This nonprovisional application claims the benefit of U.S. Provisional Application No. 62/539,111, filed Jul. 31, 2017, the disclosure of which is hereby incorporated by reference herein in its entirety.

BACKGROUND

The present disclosure is directed to cable or wiring and, more particularly, to coaxial drop cable with circumferential segmented floodant locations to stop moisture migration while providing segmented locations for clean cable preparation.

Conventional coaxial drop cable is installed in outdoor aerial application where one end of the drop cable is attached to a telephone pole while the other end is attached to a customer's building. The cable is exposed to the abrasive effects of rubbing against tress, buildings, and obstructions, and rodent chew that cross the natural path of the cable installation.

The cable that is attached to the telephone pole is typically at a higher elevation than the end of the cable that is at the customer's building. The arrangement allows a natural flow of water to drain down the cable from the higher point to the lower point of the cable, externally and internally. If the jacket has an opening caused by rodent chew, abrasions, or other methods or causes, moisture will enter into the cable and flow or wick down the braid to the lowest point of the installation creating a reservoir of water that enters the connectors/equipment, thereby causing damage to corrosion and/or shorting out the coaxial circuit.

To prevent the aforementioned problem, floodants are applied underneath the cable jacket that coats the braid to protect and minimize the moisture flow in the cable. Typically, the floodant is a non-flowing type such as APD, because it cannot enter the connectors or equipment. This non-flowing floodant does not help with protecting the cable from the effects of moisture, but it does not stop the flow of water in the cable.

In addition, there are conventional floodants on the market that are a flowing type, which are typically used in underground applications and are meant to fill the voids around the braids and jacket. These flowing floodants will seal and flow to an opening in the jacket if the jackets gets punctured by rodent chew, abrasions, or other methods or causes. However, this flowing type of floodant cannot be used in aerial applications because the floodant would flow from the higher point to the lower point of the cable into the connectors and equipment, causing damage and creating a non-working condition.

Another type of floodant that is conventionally used is a thick tar-like compound that is non-flowing, but coats the braid and fills the voids. However, the tar-like floodant is messy when exposed during the connectorization process and tends to get all over the equipment and, if introduced into the equipment, creates a non-working condition.

Therefore, it may be desirable to provide an aerial drop cable that uses a non-flowing segmented floodant that stops water flow, but does not create a mess during the connectorization process. It may also be desirable to provide other types of cable or wire, such as for example, underground coax cable, that uses a non-flowing segmented floodant that stops water flow, but does not create a mess during the connectorization process. It may also be desirable to provide an aerial drop cable, an underground coax cable, or any other cable that has an easy method for identifying where the floodant is inside the cable.

SUMMARY

According to various aspects of the disclosure, a coaxial drop cable may include an elongated inner conductor having a length, an elongated insulator coaxially surrounding the inner conductor along the length, an elongated, conductive foil layer coaxially surrounding the insulator along the length, an elongated outer conductor coaxially surrounding the foil layer along the length, a jacket coaxially surrounding the outer conductor along the length, and a non-flowing floodant between the foil layer and the jacket. The non-flowing floodant is disposed circumferentially and in a segmented manner such that the coaxial drop cable is configured to include a plurality of first areas, separated from one another along the length, that include the non-flowing floodant, and second areas, separated from one another along the length by a respective one of the first areas, having a space between the jacket and the foil layer without the non-flowing floodant. The non-flowing floodant is configured to circumferentially seal a space between the foil layer and the jacket at the plurality of first areas. Two consecutive ones of the plurality of first areas are configured to contain moisture in the second area between the two consecutive ones of the plurality of first areas.

In some aspects, the non-flowing floodant is a non-flowing, Amorphous Polypropylene flooding compound.

In some aspects, an outer surface of the jacket includes markings corresponding to locations along the length of the cable of the first areas where the non-flowing floodant is present.

In some aspects, the outer surface of the jacket includes markings corresponding to locations along the length of the cable of the second areas where the non-flowing floodant is not present.

In accordance with various aspects of the disclosure, a cable includes a core having a length, a jacket coaxially surrounding the core along the length, and a non-flowing floodant between the core and the jacket. The non-flowing floodant is disposed circumferentially and in a segmented manner such that the coaxial drop cable is configured to include a plurality of first areas, separated from one another along the length, that include the non-flowing floodant, and second areas, separated from one another along the length by a respective one of the first areas, having a space between the jacket and the core without the non-flowing floodant. The non-flowing floodant is configured to circumferentially seal a space between the core and the jacket at the plurality of first areas. Two consecutive ones of the plurality of first areas are configured to contain moisture in the second area between the two consecutive ones of the plurality of first areas.

In some aspects, the core includes an elongated inner conductor, an elongated insulator coaxially surrounding the inner conductor, and an elongated, conductive foil layer coaxially surrounding the insulator.

In some aspects, the cable further includes an elongated outer conductor coaxially surrounding the foil layer, wherein the jacket is configured to coaxially surround the outer conductor.

In some aspects, the cable further includes a second elongated, conductive foil layer coaxially surrounding the outer conductor, wherein the jacket is configured to coaxially surround the second elongated, conductive foil layer.

In some aspects, the cable further includes a second elongated outer conductor coaxially surrounding the second elongated, conductive foil layer, wherein the jacket is configured to coaxially surround the second elongated outer conductor.

In some aspects, the non-flowing floodant is a non-flowing, Amorphous Polypropylene flooding compound.

In some aspects, an outer surface of the jacket includes markings corresponding to locations along the length of the cable of the first areas where the non-flowing floodant is present.

In some aspects, an outer surface of the jacket includes markings corresponding to locations along the length of the cable of the second areas where the non-flowing floodant is not present.

In some aspects, the cable is a coaxial cable.

According to various aspects of the disclosure, a cable includes a core member having a length, a jacket surrounding the core member along the length, and a non-flowing floodant between the core member and the jacket. The non-flowing floodant is disposed in a segmented manner such that the coaxial drop cable is configured to include a plurality of first areas, separated from one another along the length, that include the non-flowing floodant, and second areas, separated from one another along the length by a respective one of the first areas, having a space between the jacket and the core member without the non-flowing floodant. The non-flowing floodant is configured to seal a space between the core member and the jacket at the plurality of first areas. Two consecutive ones of the plurality of first areas are configured to contain moisture in the second area between the two consecutive ones of the plurality of first areas.

In some aspects, the cable is a coaxial cable and the core member includes an elongated inner conductor, an elongated insulator coaxially surrounding the inner conductor, and an elongated, conductive foil layer coaxially surrounding the insulator.

In some aspects, the cable further includes an elongated outer conductor coaxially surrounding the foil layer, wherein the jacket is configured to coaxially surround the outer conductor.

In some aspects, the cable further includes a second core member, wherein the core member and the second core member each include a wire with an insulating coating.

In some aspects, the cable is an electrical cable or an Ethernet cable.

In some aspects, an outer surface of the jacket includes markings corresponding to locations along the length of the cable of the first areas where the non-flowing floodant is present.

In some aspects, an outer surface of the jacket includes markings corresponding to locations along the length of the cable of the second areas where the non-flowing floodant is not present.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
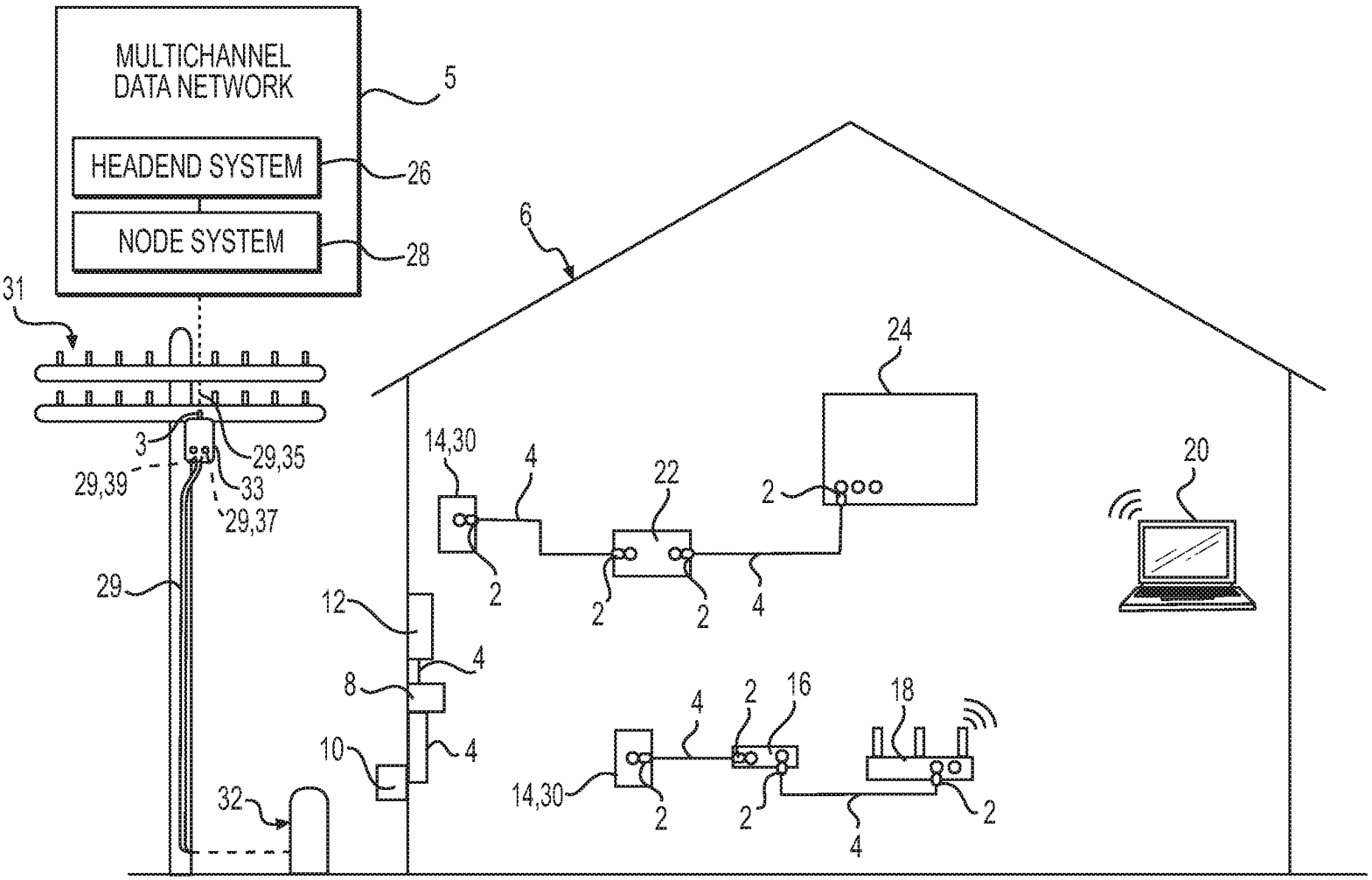
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable (coaxial drop cable) or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or pin-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or pin-type connector 3, which has a protruding pin insertable into a female interface data port of the junction device 33. The ends of the weatherized coaxial cables 37 and 39 are each attached to one of the connectors 2 described below. In this way, the connectors 2 and 3 electrically couple the cables 35, 37 and 39 to the junction device 33.

In one embodiment, the pin-type connector 3 has a male shape which is insertable into the applicable female input tap or female input data port of the junction device 33. The two female output ports of the junction device 33 are female-shaped in that they define a central hole configured to receive, and connect to, the inner conductors of the connectors 2.

In one embodiment, each input tap or input data port of the entry junction device 33 has an internally threaded wall configured to be threadably engaged with one of the pin-type connectors 3. The network 5 is operable to distribute signals through the weatherized coaxial cable 35 to the junction device 33, and then through the pin-type connector 3. The junction device 33 splits the signals to the pin-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
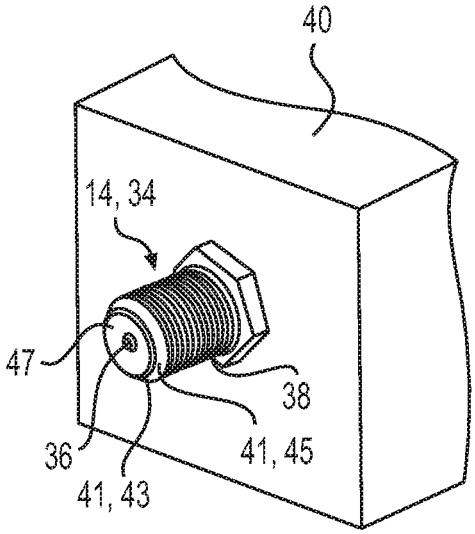
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
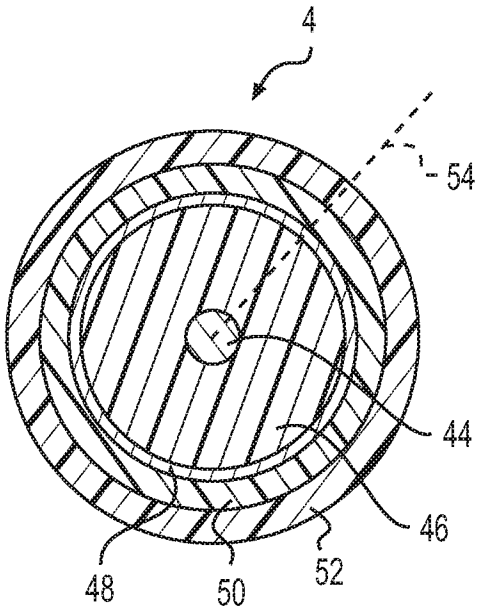
FIG. 4 is a cross-sectional view of the exemplary coaxial cable of FIG. 3.
Figure 3:
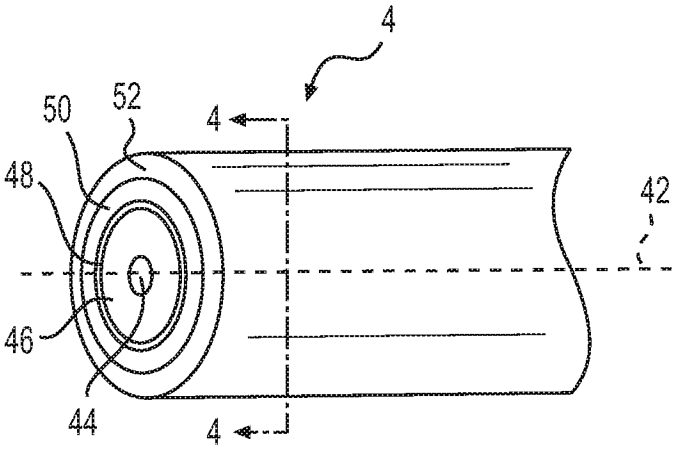
FIG. 3 is a perspective view of an exemplary coaxial cable in accordance with various aspects of the disclosure.
Figure 5:
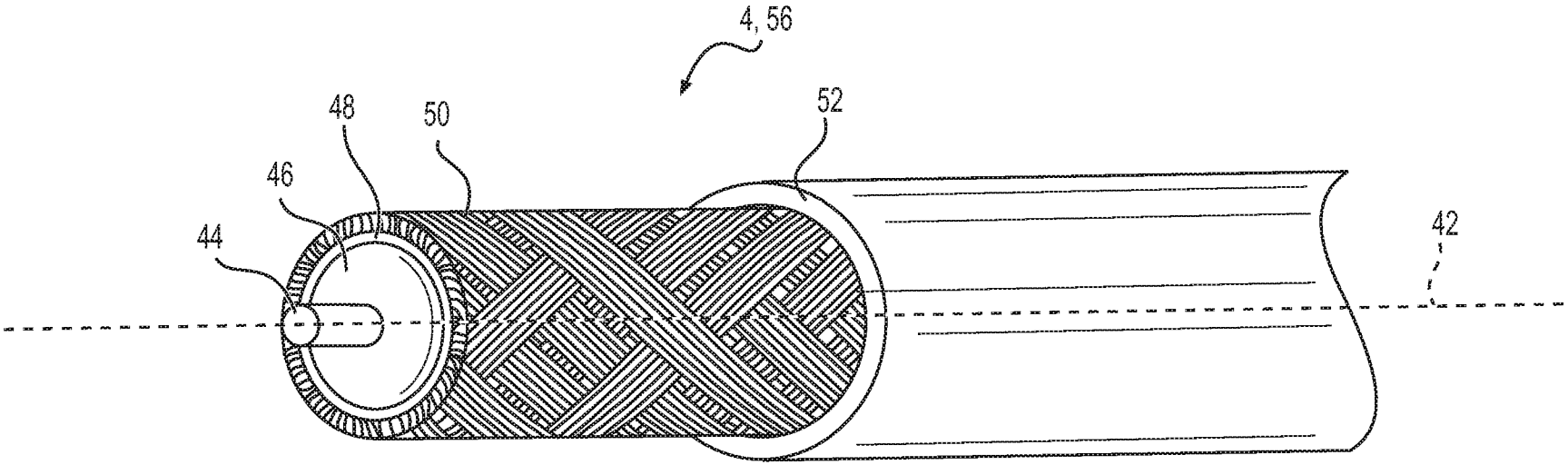
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
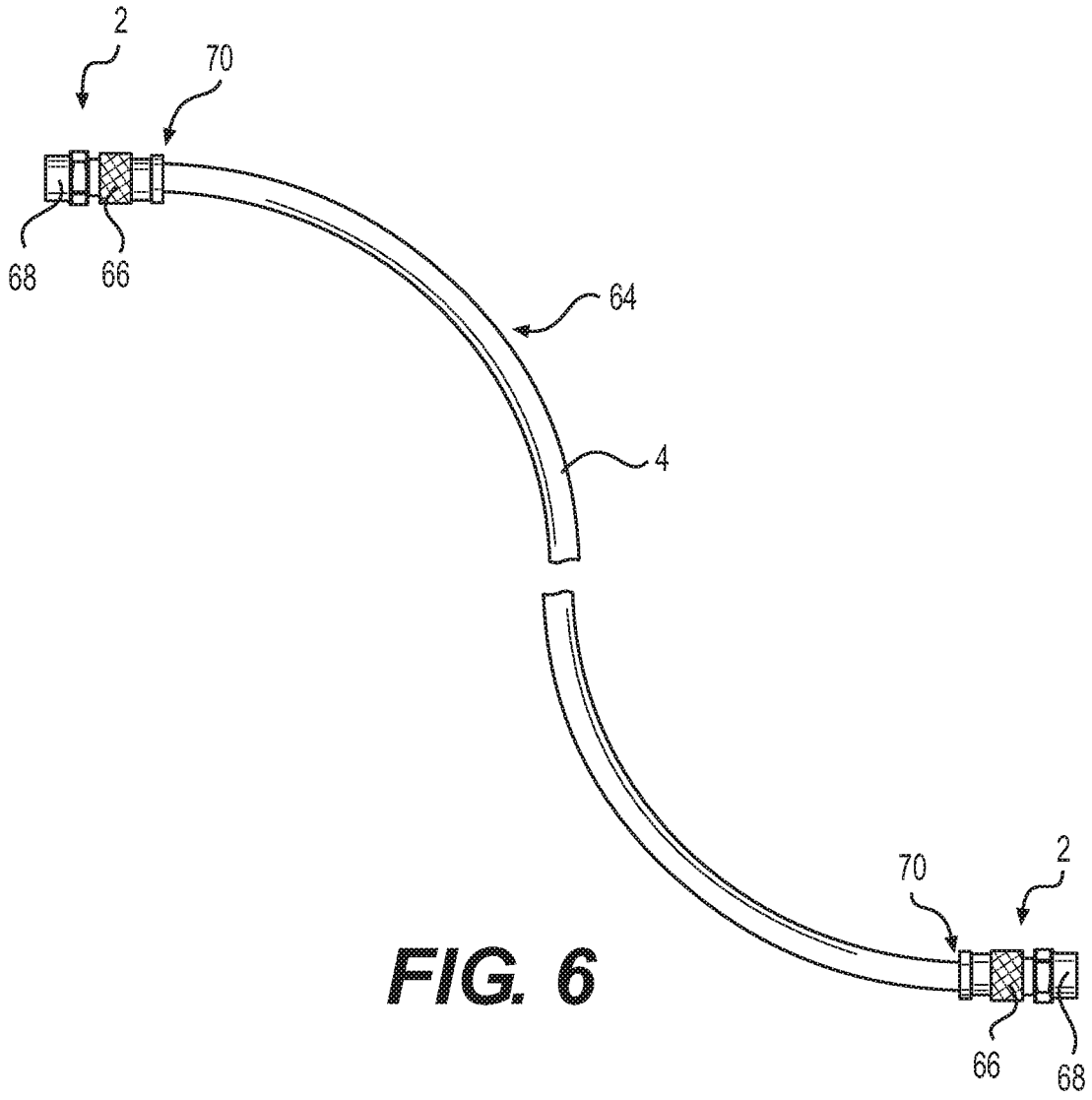
FIG. 6 is a top view of one embodiment of a coaxial cable jumper or cable assembly which is configured to be operatively coupled to the multichannel data network.
Figure 7:
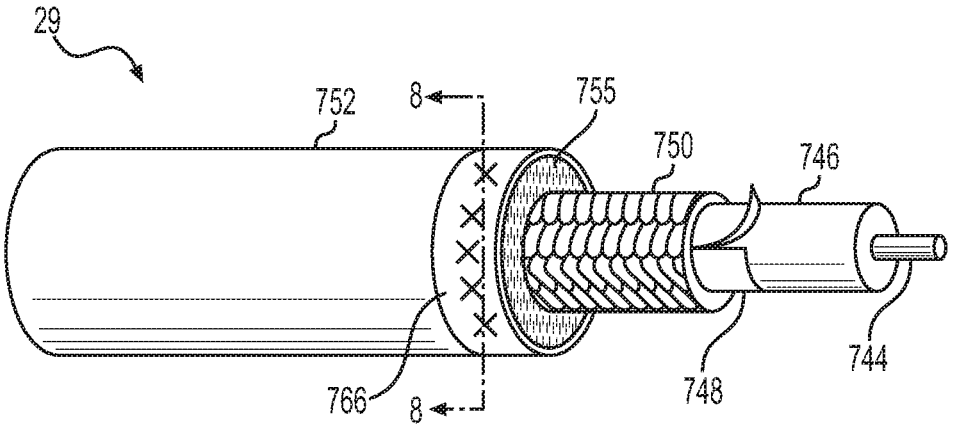
FIG. 7 is a perspective view of an exemplary embodiment of a drop cable in accordance with various aspects of the disclosure.
Figure 8:
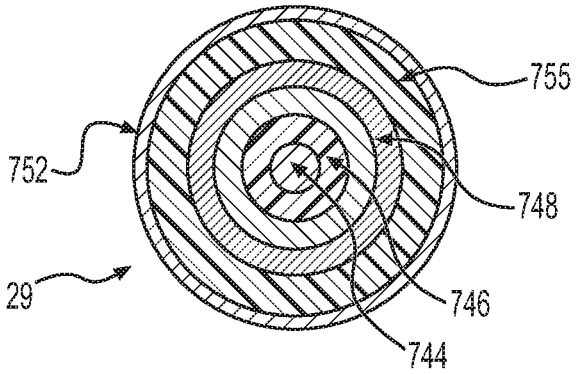
FIG. 8 is a cross-sectional view of the drop cable of FIG. 7 along line VIII-VIII of FIG. 7.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

According to the disclosure, the aforementioned connectors 2 may be configured as coaxial cable connector. When the connector 100 is installed on an interface port 14, a forward end, portion, or direction is proximal to, or toward, the interface port 14, and a rearward end, portion, or direction is distal, or away, from the interface port 14.

Referring now to FIGS. 7-10, an exemplary coaxial drop cable 29 according to the present disclosure is illustrated. Similar to coaxial cable 4, described above, the coaxial drop cable 29 includes: (a) an elongated center conductor or inner conductor 744; (b) an elongated insulator 746 coaxially surrounding the inner conductor 744; (c) an elongated, conductive foil layer 748 coaxially surrounding the insulator 746; (d) an elongated outer conductor 750, such as, for example, a screen, mesh, or braid, coaxially surrounding the foil layer 748; and (e) an elongated sheath, sleeve, or jacket 752 coaxially surrounding the outer conductor 750. In some aspects, the elongated inner conductor 744, the elongated insulator 746, and the elongated, conductive foil layer 748 coaxially surrounding the insulator 746 may be referred to as a core.

The coaxial drop cable 29 also includes a non-flowing floodant 755 between the interior surface of the jacket 752 and the outer conductor 750 at a plurality of areas 760 along a length of the cable 29. In some aspects, the floodant 755 may be coated on the interior surface of the jacket 752. Of course, the floodant 755 can penetrate the openings of the screen, mesh, or braid structure of the outer conductor 750 so as to circumferentially seal the space between the elongated, conductive foil layer 748 and the interior surface of the jacket 752 at the plurality of areas 760. In some aspects, the floodant 755 may be coated on the outer conductor 750 or on the foil layer 748. According to various aspects of the disclosure, the non-flowing floodant 755 may be a non-flowing, Amorphous Polypropylene flooding compound such as Amorphous Polypropylene Drop (APD).

Figure 9:
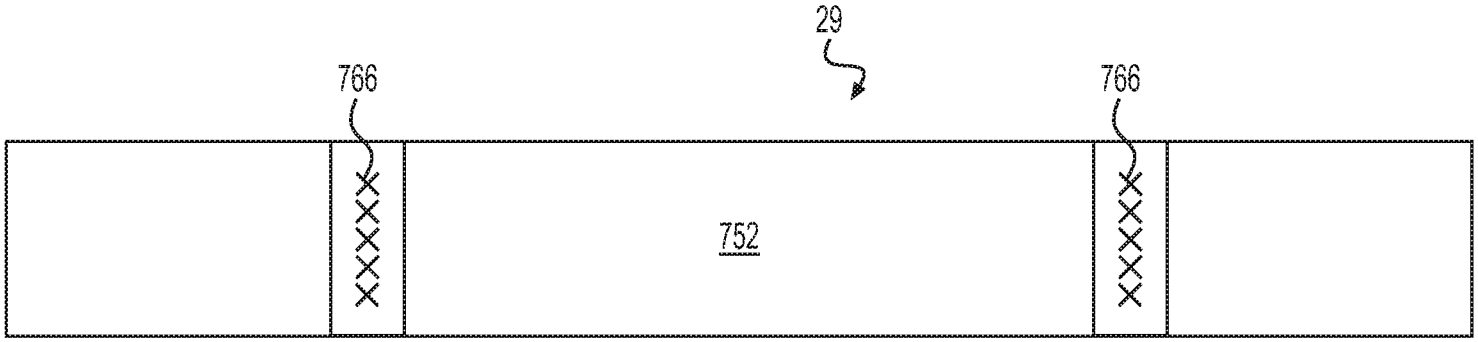
FIG. 9 is a side view of the drop cable of FIG. 7.
Figure 10:
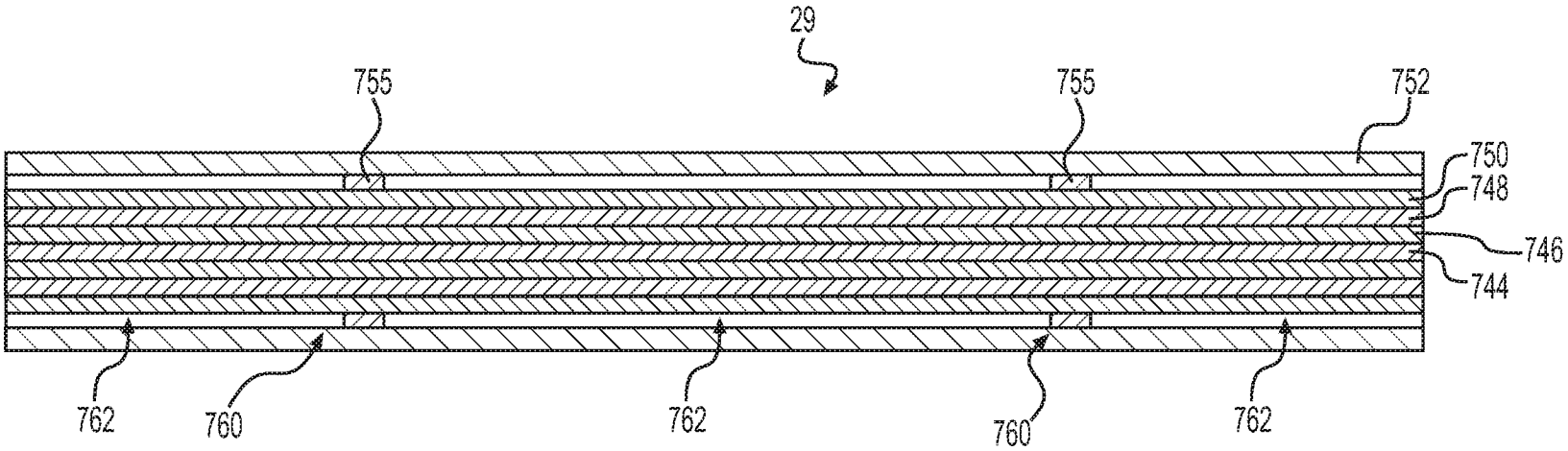
FIG. 10 is a side cross-sectional view of the drop cable of FIG. 7.

As shown in FIGS. 9 and 10, the non-flowing floodant 755 may be applied in a segmented manner such that the coaxial drop cable 29 includes areas 760 along its length that include the applied floodant 755 and areas 762 along its length that do not include floodant. If the jacket 752 develops an opening caused by rodent chew, abrasions, or other methods or causes, moisture can enter into the coaxial drop cable 29. However, the areas 760 that include the applied floodant 755 will limit the flowing or wicking of water to the area 762 without floodant between two consecutive areas 760 that include the applied floodant 755. Thus, the flowing or wicking of water to the connectors/equipment at ends of the cable is prevented by the floodant 755 at the two consecutive areas 760 that include the applied floodant 755, thereby preventing damage due to corrosion and/or shorting out the coaxial circuit. On the other hand, the areas 762 that do not include the floodant 755 provide regions of the coaxial drop cable 29 where an installer can prepare and/or terminate the coaxial drop cable 29 for connection without the mess normally associated with the use of a cable having floodant along substantially its entire length.

According to various aspects, the outer surface 764 of the jacket 752 may include markings 766 that identify locations along the length of the coaxial drop cable 29 wherein the floodant 755 is and is not present. For example, the markings 766 may include circumferential bands or stripes, longitudinal dashes, letters, numbers, shapes, or any other markings that are aligned with the areas 760 that include the applied floodant 755. In some aspects, markings may be aligned with the areas 762 that do not include the floodant 755, while the areas 760 with the floodant 755 are unmarked. In some aspects, the cable 29 may include the markings 766 that are aligned with the areas 760 that include the applied floodant 755 and markings that are aligned with the areas 762 that do not include the floodant 755. The markings 766 allow an installer to visually see where the coaxial drop cable is clear of floodant to allow for clean preparation and connectorization without a messy residue of floodant.

It should be appreciated that, although the foregoing description relative to FIGS. 7-10 is directed to an exemplary coaxial drop cable 29, in other embodiments, the cable may instead be an underground coaxial cable or any other cable or wiring. For example, persons of ordinary skill in the art would understand that sooner or later all underground conduit or cable fills with water, even direct burial grade cable. Thus, it may be desirable to provide underground coaxial cable with a non-flowing floodant applied in a segmented manner such that the underground coaxial cable includes areas along its length that include the applied floodant and areas along its length that do not include floodant. Similarly, any other cable or wiring that includes a jacket that may develop an opening due rodent chew, abrasions, or other methods or causes may be provided with a non-flowing floodant applied in a segmented manner.

Figure 11:
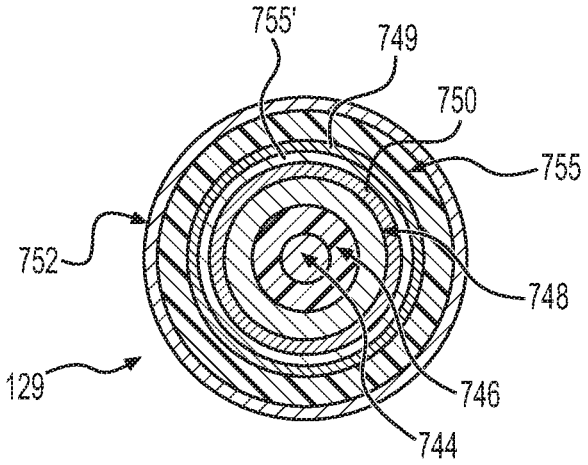
FIG. 11 is a cross-sectional view of another exemplary embodiment of a drop cable in accordance with various aspects of the disclosure along a line similar to line VIII-VIII of FIG. 7.

For example, as shown in FIG. 11, in an exemplary embodiment, the cable 129 may be a tri-shield cable including: (a) the elongated center conductor or inner conductor 744; (b) the elongated insulator 746 coaxially surrounding the inner conductor 744; (c) the elongated, conductive foil layer 748 coaxially surrounding the insulator 746; (d) the elongated outer conductor 750, such as, for example, a screen, mesh, or braid, coaxially surrounding the foil layer 748; (e) a second elongated, conductive foil layer 749 coaxially surrounding the elongated outer conductor 750; and (f) an elongated sheath, sleeve, or jacket 752 coaxially surrounding the second elongated, conductive foil layer 749. The coaxial drop cable 129 also includes a non-flowing floodant 755 between the second elongated, conductive foil layer 749 and the interior surface of the jacket 752 at a plurality of areas 760 along a length of the cable 129 so as to circumferentially seal the space between the elongated, conductive foil layer 748 and the interior surface of the jacket 752 at the plurality of areas 760. Alternatively or additionally, the coaxial drop cable 129 may include a non-flowing floodant 755' between the second elongated, conductive foil layer 749 and the elongated outer conductor 750. Of course, the floodant 755' can penetrate the openings of the screen, mesh, or braid structure of the outer conductor 750 so as to circumferentially seal the space between the elongated, conductive foil layer 748 and the second elongated, conductive foil layer 749 at the plurality of areas 760. The non-flowing floodants 755, 755' may be the same or different non-flowing, Amorphous Polypropylene flooding compounds.

Figure 12:
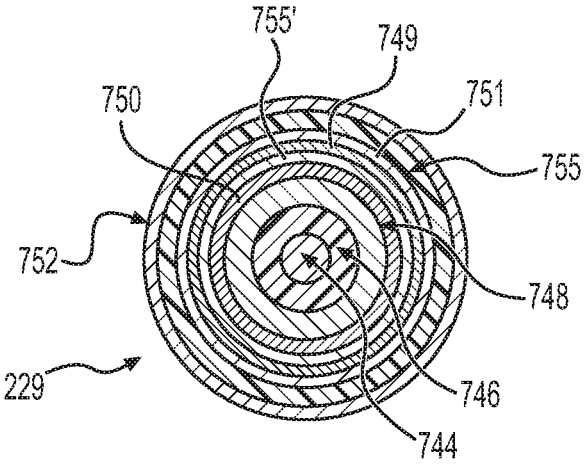
FIG. 12 is a cross-sectional view of another exemplary embodiment of a drop cable in accordance with various aspects of the disclosure along a line similar to line VIII-VIII of FIG. 7.

In another example, as shown in FIG. 12, the cable 229 may be a quad-shield cable including: (a) the elongated center conductor or inner conductor 744; (b) the elongated insulator 746 coaxially surrounding the inner conductor 744; (c) the elongated, conductive foil layer 748 coaxially surrounding the insulator 746; (d) the elongated outer conductor 750, such as, for example, a screen, mesh, or braid, coaxially surrounding the foil layer 748; (e) a second elongated, conductive foil layer 749 coaxially surrounding the elongated outer conductor 750; (f) a second elongated outer conductor 751, such as, for example, a screen, mesh, or braid, coaxially surrounding the second foil layer 749; and (g) an elongated sheath, sleeve, or jacket 752 coaxially surrounding the second elongated outer conductor 751. The coaxial drop cable 229 also includes a non-flowing floodant 755 between the second elongated outer conductor 751 and the interior surface of the jacket 752 at a plurality of areas 760 along a length of the cable 229 so as to circumferentially seal the space between the second elongated, conductive foil layer 749 and the interior surface of the jacket 752 at the plurality of areas 760. Of course, the floodant 755 can penetrate the openings of the screen, mesh, or braid structure of the second outer conductor 751 so as to circumferentially seal the space between the second elongated, conductive foil layer 749 and the interior surface of the outer jacket 752 at the plurality of areas 760.

Alternatively or additionally, the coaxial drop cable 229 may include a non-flowing floodant 755' between the second elongated, conductive foil layer 749 and the elongated outer conductor 750. Of course, the floodant 755' can penetrate the openings of the screen, mesh, or braid structure of the elongated outer conductor 750 so as to circumferentially seal the space between the second elongated, conductive foil layer 749 and the elongated, conductive foil layer 748 at the plurality of areas 760. The non-flowing floodants 755, 755' may be the same or different non-flowing, Amorphous Polypropylene flooding compounds.

Figure 13:
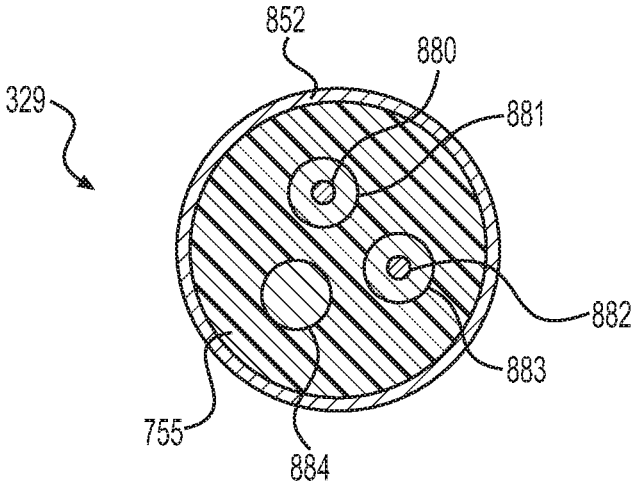
FIG. 13 is a cross-sectional view of an exemplary embodiment of an electrical cable in accordance with various aspects of the disclosure along a line similar to line VIII-VIII of FIG. 7.

In another exemplary embodiment, as shown in FIG. 13, the cable 329 may be an electrical cable having an elongated sheath, sleeve, or jacket 852 that coaxially surrounds three or more electrical wires 880, 882, 884. As would be understood by persons skilled in the art, the electrical cable may include a "hot" conductor 880 with an insulated coating 881, a neutral conductor 882 with an insulated coating 883, and a ground wire 884 (either bare or insulated). It should be appreciated that the "hot" conductor 880, the neutral conductor 992, and/or the ground wire 884 can be solid wires or braided bundles of wire. Each wire with coating and each bare wire may be referred to as a core wire. The electrical cable 329 also includes a non-flowing floodant 755 between the insulated coatings 881, 883, the ground wire 884, and the interior surface of the jacket 852 at a plurality of areas 760 along a length of the cable 329 so as to circumferentially seal the space between the insulated coatings 881, 883, the ground wire 884, and the interior surface of the jacket 852 at the plurality of areas 760.

Figure 14:
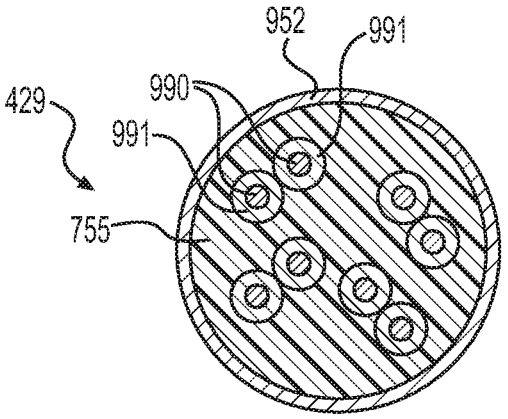
FIG. 14 is a cross-sectional view of an exemplary embodiment of an Ethernet cable in accordance with various aspects of the disclosure along a line similar to line VIII-VIII of FIG. 7.

As shown in FIG. 14, in another exemplary embodiment, the cable 429 may be an Ethernet cable having an elongated sheath, sleeve, or jacket 952 that coaxially surrounds four twisted pairs of solid wires 990. Each of the wires 990 includes an insulated coating 991. Each wire 990 with coating 991 may be referred to as a core wire. The Ethernet cable 429 also includes a non-flowing floodant 755 between the insulated coatings 991 of the wires 990 and the interior surface of the jacket 952 at a plurality of areas 760 along a length of the cable 429 so as to circumferentially seal the space between the insulated coatings 991 and the interior surface of the jacket 852 at the plurality of areas 760.

In any of the foregoing embodiments of cable or wire, moisture can enter inside the jacket of the cable or wire and cause damage due to corrosion and/or shorting out of an electric circuit. However, the aforementioned areas that include the applied floodant will limit the flowing or wicking of water to the area without floodant between two consecutive areas that include the applied floodant. Thus, the flowing or wicking of water to the connectors/equipment is stopped at the two consecutive areas that include the applied floodant.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial drop cable comprising:

an elongated inner conductor having a length;

an elongated insulator coaxially surrounding the inner conductor along the length;

an elongated, conductive foil layer coaxially surrounding the insulator along the length;

an elongated outer conductor coaxially surrounding the foil layer along the length;

a jacket coaxially surrounding the outer conductor along the length; and a plurality of continuous annular rings of a non-flowing floodant between the foil layer and the jacket, wherein the continuous annular rings of the non-flowing floodant are disposed circumferentially and in a segmented manner such that the coaxial drop cable is configured to include a plurality of first areas, separated from one another along the length, that include the non-flowing floodant, and second areas, separated from one another along the length by a respective one of the first areas, having a space between the jacket and the foil layer without the non-flowing floodant, wherein the non-flowing floodant is configured to circumferentially seal a space between the foil layer and the jacket at the plurality of first areas, and wherein two consecutive ones of the plurality of first areas are configured to contain moisture in the second area between the two consecutive ones of the plurality of first areas.

2. The coaxial drop cable of claim 1, wherein the non-flowing floodant is a non-flowing, Amorphous Polypropylene flooding compound.

3. The coaxial drop cable of claim 1, wherein an outer surface of the jacket includes markings corresponding to locations along the length of the cable of the first areas where the continuous annular rings of the non-flowing floodant is present.

4. The coaxial drop cable of claim 1, wherein an outer surface of the jacket includes markings corresponding to locations along the length of the cable of the second areas where the continuous annular rings of the non-flowing floodant is not present.

5. A cable comprising:

a core having a length;

a jacket coaxially surrounding the core along the length; and a plurality of continuous annular rings of a non-flowing floodant between the core and the jacket, wherein the continuous annular rings of the non-flowing floodant are disposed circumferentially and in a segmented manner such that the coaxial drop cable is configured to include a plurality of first areas, separated from one another along the length, that include the non-flowing floodant, and second areas, separated from one another along the length by a respective one of the first areas, having a space between the jacket and the core without the non-flowing floodant, wherein the non-flowing floodant is configured to circumferentially seal a space between the core and the jacket at the plurality of first areas, and wherein two consecutive ones of the plurality of first areas are configured to contain moisture in the second area between the two consecutive ones of the plurality of first areas.

6. The cable of claim 5, wherein the core includes:

an elongated inner conductor;

an elongated insulator coaxially surrounding the inner conductor; and an elongated, conductive foil layer coaxially surrounding the insulator.

7. The cable of claim 6, further comprising an elongated outer conductor coaxially surrounding the foil layer, wherein the jacket is configured to coaxially surround the outer conductor.

8. The cable of claim 7, further comprising a second elongated, conductive foil layer coaxially surrounding the outer conductor, wherein the jacket is configured to coaxially surround the second elongated, conductive foil layer.

9. The cable of claim 7, further comprising a second elongated outer conductor coaxially surrounding the second elongated, conductive foil layer, wherein the jacket is configured to coaxially surround the second elongated outer conductor.

10. The cable of claim 5, wherein the non-flowing floodant is a non-flowing, Amorphous Polypropylene flooding compound.

11. The cable of claim 5, wherein an outer surface of the jacket includes markings corresponding to locations along the length of the cable of the first areas where the continuous annular rings of the non-flowing floodant is present.

12. The cable of claim 5, wherein an outer surface of the jacket includes markings corresponding to locations along the length of the cable of the second areas where the continuous annular rings of the non-flowing floodant is not present.

13. The cable of claim 5, wherein the cable is a coaxial cable.

14. A cable comprising:

a core member having a length;

a jacket surrounding the core member along the length; and a plurality of continuous annular rings of a non-flowing floodant between the core member and the jacket, wherein the continuous annular rings of the non-flowing floodant are disposed in a segmented manner such that the coaxial drop cable is configured to include a plurality of first areas, separated from one another along the length, that include the non-flowing floodant, and second areas, separated from one another along the length by a respective one of the first areas, having a space between the jacket and the core member without the non-flowing floodant, wherein the non-flowing floodant is configured to seal a space between the core member and the jacket at the plurality of first areas, and wherein two consecutive ones of the plurality of first areas are configured to contain moisture in the second area between the two consecutive ones of the plurality of first areas.

15. The cable of claim 14, wherein the cable is a coaxial cable and the core member includes:

an elongated inner conductor;

an elongated insulator coaxially surrounding the inner conductor; and an elongated, conductive foil layer coaxially surrounding the insulator.

16. The cable of claim 15, further comprising an elongated outer conductor coaxially surrounding the foil layer, wherein the jacket is configured to coaxially surround the outer conductor.

17. The cable of claim 14, further comprising a second core member, wherein the core member and the second core member each include a wire with an insulating coating.

18. The cable of claim 17, wherein the cable is an electrical cable or an Ethernet cable.

19. The cable of claim 14, wherein an outer surface of the jacket includes markings corresponding to locations along the length of the cable of the first areas where the continuous annular rings of the non-flowing floodant is present.

20. The cable of claim 14, wherein an outer surface of the jacket includes markings corresponding to locations along the length of the cable of the second areas where the continuous annular rings of the non-flowing floodant is not present.

* * * * *